United States Patent [19]

Ihara

[11] 4,027,123

[45] May 31, 1977

[54] VACUUM CIRCUIT BREAKER COMPRISING SERIES CONNECTED VACUUM INTERRUPTERS AND CAPACITIVE VOLTAGE-DISTRIBUTION MEANS

[75] Inventor: Satoru Ihara, Wallingford, Pa.

[73] Assignee: General Electric Company, Philadelphia, Pa.

[22] Filed: Mar. 11, 1975

[21] Appl. No.: 557,429

[52] U.S. Cl. ..... 200/144 B; 200/144 AP; 200/145; 361/13

[51] Int. Cl.[2] ..... H01H 33/66

[58] Field of Search ..... 200/144 B, 145, 144 AP; 317/11

[56] References Cited

UNITED STATES PATENTS

| | | | |
|---|---|---|---|
| 2,530,939 | 11/1950 | Browne | 317/11 |
| 2,840,670 | 6/1958 | Leeds et al. | 200/145 |
| 3,147,356 | 9/1964 | Luehring | 200/144 B |
| 3,604,869 | 9/1971 | Wilson | 200/144 AP |
| 3,611,031 | 10/1971 | Lutz | 200/144 AP |
| 3,839,612 | 10/1974 | Badey et al. | 200/144 B |

*Primary Examiner*—Robert S. Macon
*Attorney, Agent, or Firm*—William Freedman

[57] ABSTRACT

This circuit breaker comprises a plurality of vacuum interrupters electrically connected in series. The voltage distribution across the interrupters is controlled by a plurality of capacitive circuits respectively connected across the interrupters. Each of these capacitive circuits comprises: (a) the series combination of a relatively large main capacitor and a resistor connected across its associated interrupter, and (b) means comprising a relatively small auxiliary capacitor for producing a high frequency oscillatory current through said associated interrupter upon spark-over of the interrupter, which oscillatory current produces a natural current zero through said associated interrupter and clearance by said associated interrupter at said natural current zero well before said associated main capacitor has had time to fully discharge through said associated sparked-over interrupter.

9 Claims, 3 Drawing Figures

Fig. 1.
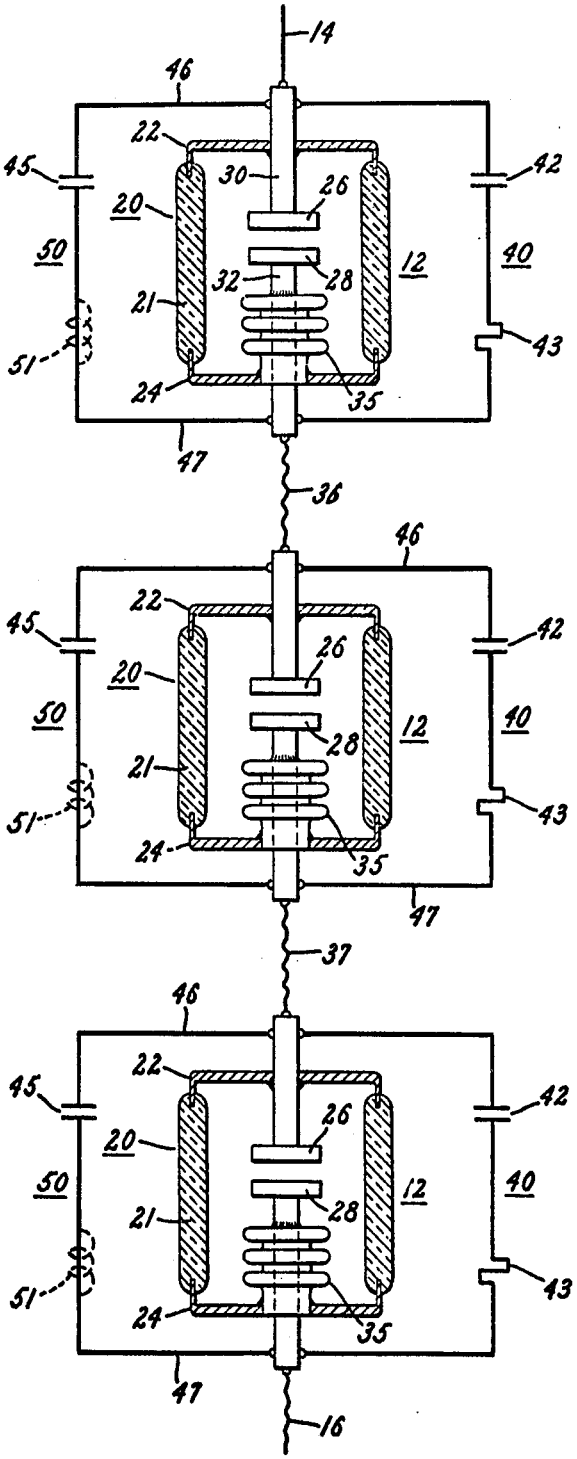
Fig. 3.
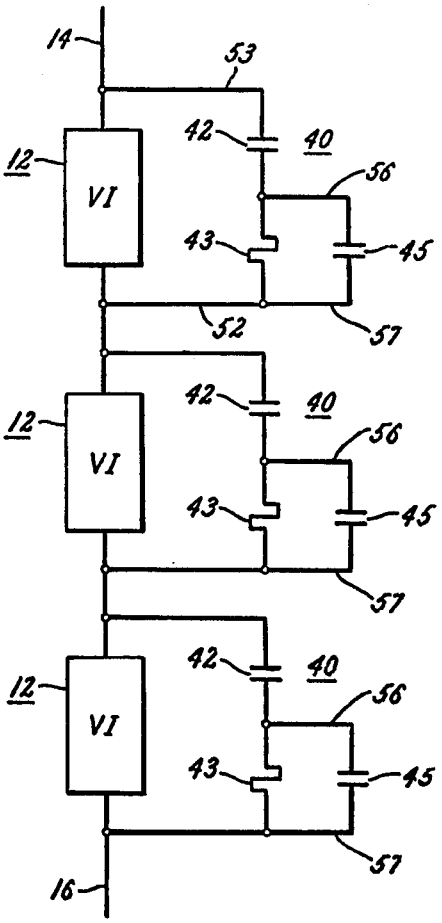
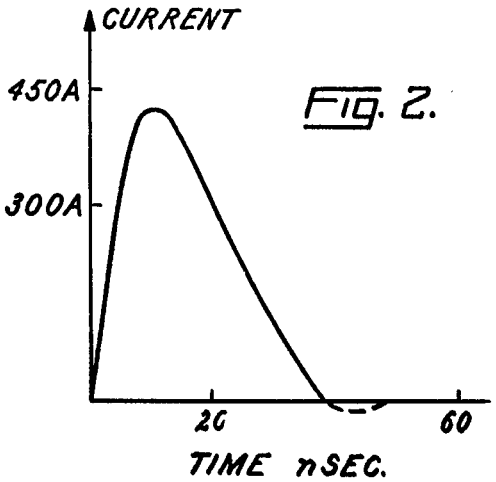
Fig. 2.

VACUUM CIRCUIT BREAKER COMPRISING SERIES CONNECTED VACUUM INTERRUPTERS AND CAPACITIVE VOLTAGE-DISTRIBUTION MEANS

BACKGROUND

This invention relates to a multi-break circuit breaker comprising a plurality of vacuum-type circuit interrupters electrically connected in series and, more particularly, relates to means for controlling the voltage distribution between the interrupters.

A common way of controlling the voltage distribution between the interrupters of a multi-break circuit breaker is by connecting capacitors of appropriate size directly across the individual interrupters. This technique is described in detail in U.S. Pat. No. 2,840,670-Leeds, where it is pointed out that one of the problems involved in using this technique is to overcome the effects of capacitance-to-ground between the high voltage parts and ground. As is recognized by Leeds, one approach that can be used to overcome the effects of such capacitance-to-ground is to increase the size of the voltage distributing capacitances across the interrupters, especially across the end interrupters of the circuit breaker.

There are, however, certain disadvantages to this approach. For example, if one of the interrupters should spark-over, causing a discharge of the relatively large capacitor connected thereacross, the resulting relatively large energy transfer will induce unfavorable electrical transients in the system that can force a breakdown of the circuit breaker itself. The chances for such a breakdown are increased if the interrupter that first sparks-over is an end interrupter which has a greater amount of capacitance across it than the other interrupters.

Another disadvantage of connecting large capacitances directly across the interrupters is that spark-over of an interrupter will collapse the voltage across the sparked-over interrupter for an appreciable time, causing the full voltage to appear across the remaining interrupters, which voltage may be distributed in an unfavorable manner that forces a breakdown of these remaining interrupters.

In a vacuum-type circuit breaker, still another problem results from connecting a large capacitor directly across an interrupter. More specifically, the presence of a large capacitor connected directly across a vacuum-type interrupter seems to detract from the capacitance-switching ability of the vacuum interrupter. The reasons for this are not fully understood, but one of them seems to be that the high peak currents resulting from discharge of a large capacitor through a vacuum interrupter upon spark-over materially reduce its dielectric strength. High dielectric strength is needed by the interrupter for good capacitance-switching performance.

SUMMARY

Accordingly, an object of my invention is to provide capacitive grading means that can be used in a vacuum-type circuit breaker with less likelihood of weakening the dielectric strength of any vacuum interrupter that sparks-over.

Another object is to provide capacitive grading means constructed in such a way that spark-over of an interrupter results in reduced energy transfer through the sparked-over interrupter, as compared to the energy transfer occurring when the capacitive grading means comprises large capacitors directly connected across the interrupters, thus reducing the severity of the voltage transient resulting from such spark-over.

Another object is to provide capacitive grading means which is constructed in such a way that spark-over of one of the interrupters of a plurality of series-connected interrupters usually does not result in the full circuit-breaker voltage being shifted to the remaining interrupters.

Another object is to provide capacitive grading means which is constructed in such a way that any interrupter that sparks-over can recover its dielectric strength before the voltage distributing capacitor connected thereacross can fully discharge.

In carrying out my invention in one form, I connected across each of the vacuum interrupters a capacitive circuit that comprises: (a) the series combination of a relatively large main capacitor and a resistor connected across the associated interrupter, and (b) means comprising a relatively small auxiliary capacitor for producing a high frequency oscillatory current through said associated interrupter upon spark-over of the interrupter, which oscillatory current produces a natural current zero through said associated interrupter and clearance by said associated interrupter at said natural current zero well before said associated main capacitor has had time to fully discharge through said associated sparked-over interrupter.

BRIEF DESCRIPTION OF DRAWINGS

For a better understanding of my invention, reference may be had to the following description taken in conjunction with the accompanying drawings, wherein:

FIG. 1 is a schematic showing of a vacuum-type circuit breaker embodying one form of my invention. The circuit breaker is depicted in its fully-open position.

FIG. 2 is a graphical representation illustrating capacitor discharge current through one of the interrupters following its spark-over.

FIG. 3 is a schematic showing of another vacuum-type circuit breaker embodying another form of my invention.

DETAILED DESCRIPTION OF PREFERRED EMBODIMENTS

Referring now to FIG. 1, the illustrated circuit breaker comprises a plurality of vacuum-type circuit interrupters 12 electrically connected in series with each other between a pair of spaced-apart circuit breaker terminals 14 and 16, which are adapted to be connected in one phase of a high-voltage alternating-current power circuit. The interrupters 12 are substantially indentical, and each may be of a conventional design. As such, each comprises a highly evacuated envelope 20 comprising a tubular casing 21 of insulating material and a pair of metal end caps 22 and 24 at its opposite ends sealed to the tubular casing.

Within the evacuated envelope of each interrupter is a pair of relatively movable contacts 26 and 28 shown in their spaced-apart fully-open position. Contact 26 is a stationary contact mounted on the lower end of a conductive stationary contact rod 30. Contact 28 is a movable contact mounted on the upper end of a movable conductive contact rod 32. The movable contact rod 32 extends freely through the lower end cap 24. A flexible metallic bellows 35 provides a seal between rod 32 and end cap 24 to permit vertical motion of the rod relative to the end cap without impairing the vacuum inside the envelope 20.

Closing of the interrupter is effected by driving the contact rod 32 upwardly to drive movable contact 28 into enegagement with stationary contact 26. Opening is effected by driving contact rod 32 downwardly from its closed position into the illustrated open pistion, thereby separating the contacts. During an opening operation, the usual arc formed between the contacts upon contact-separation is prevented from re-igniting after an early natural current zero by the high dielectric strength of the vacuum inside the envelope 20.

The circuit breaker includes a common operating mechanism (not shown) for the interrupters that acts during circuit-breaker opening to separate the contacts of all the interrupters substantially simultaneously and acts during circuit-breaker closing to reengage the contact substantially simultaneously. The mechanism is coupled to the interrupters through a linkage (not shown) that is suitably connected to the movable contact rods 32 of all the interrupters.

The interrupters can be physically mounted in any suitable conventional manner, but they are preferably mounted in the general manner illustrated and claimed in U.S. Pat. No. 3,869,312-Badey and Oppel, assigned to the assignee of the present invention, where they are shown located in a grounded metal tank filled with pressurized insulating gas. For electrically connecting the interrupters 12 in series in FIG. 1, a plurality of flexible conductors 36 and 37 are utilized.

For controlling the distribution of the voltage that is present between terminals 14 and 16 the individual interrupters 12, I provide a plurality of capacitive circuits 40 respectively connected across the interrupters. The capacitive circuit 40 for each individual interrupter comprises the series combination of a main capacitor 42 and a resistor 43 connected across the interrupter. This capacitive circuit further comprises an auxiliary capacitor 45 that is substantially smaller than the main capacitor 42. The auxiliary capacitor 45 is also connected across the interrupter and is in parallel with the series combination 42, 43.

Typically the auxiliary capacitor 45 has a capacitance of a few hundred picofarads. The main capacitor 42 typically is several times larger than the auxiliary capacitor. The resistor 43 typically has a resistance in the range of 500 to 2000 ohms. These values are given by way of example and not limitation.

When no current is flowing through the vacuum interrupters and voltage is present between terminals 14 and 16, this voltage is divided between the interrupters in a manner dependent upon the size of the main capacitors 42. In general, the larger the capacitor connected across a particular interrupter, the smaller will be the percentage of the total voltage appearing across that particular interrupter.

Should one of the interrupters spark-over when the circuit breaker is in its illustrated open position or in a partially open position, the associated main capacitor 42, which is then fully charged, will begin discharging through the sparked-over interrupter. But in the illustrated arrangement this discharge is delayed by the presence of the resistor 43 in series with the main capacitor 42, which resistor serves also to limit the peak current in the circuit loop formed by the sparked-over interrupter and components 42 and 43.

While discharge of the main capacitor is thus being delayed, the associated auxiliary capacitor 45 is free to rapidly discharge through the circuit loop 50 formed by conductor 46, the sparked-over interrupter, conductor 47, and the auxiliary capacitor 45. The inherent inductance of this circuit loop 50 is depicted by the coil 51 shown in dotted lines. This loop 50 is an underdamped, or oscillatory, circuit having a relatively high natural frequency, as a result of which the current through the interrupter quickly passes through a natural current zero. A vacuum interrupter is characterized by exceptionally high rates of dielectric recovery after arcing and, for this reason, is usually able to interrupt high frequency current therethrough at the first current zero. If unable to interrrupt at the first natural current zero. the interrupter will do so at an early one of the natural current zeros that immediately follow.

It is important that in the circuit loop 50 the high frequency resistance be sufficiently low and the inductance 51 be sufficiently high to allow the circuit loop to be underdamped, or oscillatory. If the circuit is overdamped, the current through the interrupter resulting upon discharge of auxiliary capacitor 45 will not pass through zero to allow the interrupter 12 to interrupt at the desired early instant. FIG. 2 is a graph showing in solid lines a typical time history of the current through the interrupter after a spark-over of the interrupter, assuming interruption at the first current zero. If interruption does not occur at the first current zero. the current will continue as indicated by the dotted line, offering a second opportunity for interruption at the second current zero. In the graph, the first current zero is seen to occur at approximately 38 nanoseconds after spark-over initiation. It is to be understood that a portion of the current depicted in FIG. 2 represents initial discharge current from the main capacitor 42 as limited by resistor 43.

When the above-described interruption of a high frequency current through the interrupter occurs, most of the original charge still remains in the main capacitor 42 in view of the delay in its discharge imposed by resistor 43. Because of the reduced energy transfer through the sparked-over interrupter (as compared to that occurring in those arrangements where a main capacitor such as 42 fully discharges in response to spark-over of its associated interrupter) there is a reduction in the severity of the system transients produced by spark-over, thus reducing the likelihood that such transients will cause breakdown of the entire circuit breaker.

Moreover, if the sparked-over interrupter quickly clears the high frequency current therethrough while most of the charge remains on the main capacitor 42 of the sparked-over interrupter, as above described, the remaining interrupters will not be subjected to the full voltage appearing between terminals 14 and 16, thus reducing the likelihood of breakdown of these remaining interrupters.

Still further, since the peak current through the sparked-over interrupter is limited by the resistor 43, there is less chance of impairment of the interrupter's dielectric strength by the current flowing after spark-over. The peak current from the auxiliary capacitor is much lower than that which would flow through the interrupter if the main capacitor discharged therethrough without retardation from an impedance such as resistor 43.

The auxiliary capacitor 45 connected across each interrupter is located externally of the interrupter and is to be distinguished from the inherent capacitance between the spaced contacts of the interrupter. Typically, the auxiliary capacitor will have a capacitance of a few hundred picofarads, whereas the inherent intercontact capacitance will typically be several picofarads when the contacts are in or near their fully-open position. The external location of the auxiliary capacitor enables me to select leads 46, 47 that hve sufficient inductance to provide the required underdamping of circuit loop 50.

The above-described capacitive circuits 40 that I use for voltage-distributing purposes are to be distinguished from capacitive shunt circuits that have been proposed, as in U.S. Patent 2,530,939-Browne, for the purpose of reducing the rate of rise of the recovery voltage appearing across the circuit breaker. In distince contrast to these latter circuits, my capacitive circuits 40, when used in a typical multi-break circuit breaker, have an impedance that is sufficiently high as to exert no significant effect on the rate of rise of the recovery voltage appearing across the circuit breaker.

FIG. 3 illustrated another embodiment of the invention, with the circuit breaker assumed to be in a partially-open or fully-open position and no current passing through the vacuum interrupters 12 between circuit breaker terminals 14 and 16. The same reference numerals are used in FIG. 3 as in FIG. 1 to designate corresponding parts. In the embodiment of FIG. 3, in each capacitor circuit 40, the auxiliary capacitor 45, instead of being connected directly across the interrupter, is connected across the resistor 43 by leads 56 and 57. Prior to spark-over of the associated interrupter 12, the auxiliary capacitor 45 is fully discharged through the resistor 43. But after spark-over of the interrupter, the auxiliary capacitor 45 is charged by partial discharge of the main grading capacitor 42. This charging operation takes place through an underdamped circuit loop comprising the following elements in series: main capacitor 42, conductor 56, auxiliary capacitor 45, conductors 57 and 52, the sparked-over vacuum interrupter 12, and conductor 53. This current is a high frequency oscillatory current that typically has a wave shape similar to that of FIG. 2. The auxiliary capacitor 45 serves substantially the some role in FIG. 3 as in FIG. 1, i.e., forcing the current through the vacuum interrupter to zero within the desired short time after spark-over so that the interrupter can interrupt this current and recover its dielectric strength while the main capacitor still retains most of its pre-spark-over charge.

Although FIG. 1 illustrates the circuit breaker in its fully-open position, it is to be understood that the capacitive voltage-distributing circuits operate in essentially the same manner as described when the circuit breaker is partially open.

While I have shown and described particular embodiments of my invention, it will be obvious to those skilled in the art that various changes and modifications may be made without departing from my invention in its broader aspects; and I, therefore, intend in the appended claims to cover all such changes and modifications as fall within the true spirit and scope of my invention.

What I claim as new and desire to secure by Letters Patent of the United States is:

1. A multi-break alternating-current vacuum circuit breaker comprising:

a. a plurality of vacuum-type circuit interrupters, b. means for connecting said interrupters electrically in series, c. means for controlling the distribution of voltage appearing across said series combination of interrupters comprising a plurality of capacitive circuits respectively connected across said vacuum interrupters, the capacitive circuits having sufficient impedance as to exert no significant effect on the rate of rise of recovery voltage appearing across the circuit breaker after interruption, d. the capacitive circuit across one of said interrupters comprising:

($d_1$). the series combination of a relatively large main capacitor and a resistor connected across said one interrupter, and ($d_2$). a relatively small auxiliary capacitor external to said one interrupter and connected across said one interrupter in parallel with said series combination of main capacitor and resistor, e. the circuit loop comprising said one vacuum interrupter and said auxiliary capacitor connected thereacross being underdamped so that discharge of said auxiliary capacitor through said one interrupter upon spark-over of said one interrupter results in an oscillatory current through said circuit loop that produces a natural current zero through said one interrupter and clearance by said one interrupter at said natural current zero well before said main capacitor has had time to fully discharge through said one sparked-over interrupter.

2. A multi-break alternating-current vacuum circuit breaker comprising:

a. a plurality of vacuum-type circuit interrrupters, b. means for connecting said interrupters electrically in series, c. means for controlling the distribution of voltage appearing across said series combination of interrupters comprising a plurality of capacitive circuits respectively connected across said vacuum interrupters, the capacitive circuits having sufficient impedance as to exert no significant effect on the rate of rise of recovery voltage appearing across the circuit breader after interruption, d. the capacitive circuit across one of said interrupters comprising:

($d_1$). the series combination of a relatively large main capacitor and a resistor connected across said one interrupter, and ($d_2$). means comprising a relatively small auxiliary capacitor external to said one interrupter connected in an underdamped circuit with said one vacuum interrupter for producing a relatively high frequency oscillatory current through said one interrupter upon spark-over of said one interrupter, which oscillatory current produces a natural current zero through said one interrupter and clearance by said one interrupter at said natural current zero well before said main capacitor has had time to fully discharge through said one sparked-over interrupter.

3. The circuit breaker of claim 2 in which said auxiliary capacitor is connected across said one interrupter in parallel with the series combination of said main capacitor and said resistor, the circuit loop comprising said one vacuum interrupter and said auxiliary capacitor connected there-across being underdamped.

4. The circuit breaker of claim 2 in which said auxiliary capacitor is connected in parallel with said resistor and in series with said main capacitor so as to provide, upon spark-over of said one interrupter, an underdamped circuit loop including the series combination of said main capacitor, said auxiliary capacitor, and said one sparked-over interrupter.

5. The circuit breaker of claim 4 in which:

a. said auxiliary capacitor is maintained discharged by said resistor while said one interrupter is open and intact, and b. said auxiliary capacitor is charged by partial discharge of said main capacitor through said underdamped circuit loop upon spark-over of said one interrupter.

6. The circuit breaker of claim 1 in which:

a. the capacitive circuit across each of the remaining interrupters comprises:

($a_1$). the series combination of a relatively large main capacitor and a resistor connected across the associated interrupter, and ($a_2$). a relatively small auxiliary capacitor external to said associated interrupter and connected across said associated interrupter in parallel with said series combination of main capacitor and resistor, and b. the circuit loop comprising said associated vacuum interrupter and said auxiliary capacitor connected thereacross in underdamped so that discharge of said auxiliary capacitor through said associated interrupter upon spark-over of said associated interrupter results in an oscillatory current through said circuit loop that produces a natural current zero through said associated interrupter and clearance by said associated interrupter at said natural current zero well before said associated main capacitor has had time to fully discharge through said associated sparked-over interrupter.

7. The circuit breaker of claim 2 in which the capacitive circuit across each of the remaining interrupters comprises:

a. the series combination of a relatively large main capacitor and a resistor connected across said associated interrupter, and b. means comprising a relatively small auxiliary capacitor external to said associated interrupter and connected in an underdamped circuit with said associated interrupter for producing a relatively high frequency oscillatory current through said associated interrupter upon spark-over of said associated interrupter, which oscillatory current produces a natural current zero through said associated interrupter and clearance by said associated interrupter at said natural current zero well before said main capacitor has had time to fully discharge through said associated sparked-over interrupter.

8. The circuit breaker of claim 7 in which the auxiliary capacitor in each of the capacitive circuits across said remaining interrupters is connected across its associated interrupter in parallel with the series combination of its associated main capacitor and resistor, the circuit loop comprising said associated vacuum interrupter and said auxiliary capacitor connected thereacross being underdamped.

9. The circuit breaker of claim 7 in which the auxiliary capacitor in each of the capacitive circuits across said remaining interrupters is connected in parallel with its associated resistor and in series with its associated main capacitor so as to provide, upon spark-over of said associated interrupter, an underdamped circuit loop including the series combination of the associated main capacitor, the associated auxiliary capacitor, and the associated sparked-over interrupter.

* * * * *